US005143232A

United States Patent [19]

Stewart et al.

[11] Patent Number: 5,143,232

[45] Date of Patent: Sep. 1, 1992

[54] CRANE LOAD INSTRUMENT AND METHOD THEREFOR

[76] Inventors: James T. Stewart, 17923 Fireside Dr., Spring, Tex. 77379; David C. Toalson, 330 Meissner Rd., Bellville, Tex. 77418

[21] Appl. No.: 761,439

[22] Filed: Sep. 18, 1991

[51] Int. Cl.[5] ..... B66C 13/16

[52] U.S. Cl. ..... 212/154

[58] Field of Search ..... 212/154, 149, 150, 153, 212/155; 340/685, 689

[56] References Cited

U.S. PATENT DOCUMENTS

| | | | |
|---|---|---|---|
| 3,641,551 | 2/1972 | Sterner et al. | 212/154 |
| 4,212,006 | 7/1980 | Cakebread et al. | 212/154 |
| 4,395,706 | 7/1983 | Garber | 212/154 |
| 4,752,012 | 6/1988 | Juergens | 212/154 |

*Primary Examiner*—Jesûs D. Sotelo
*Assistant Examiner*—Stephen P. Avila
*Attorney, Agent, or Firm*—James L. Jackson

[57] ABSTRACT

A crane load detection system is provided having an electronic strain gage located in series with the deadline of the boom and located adjacent the gantry tie-down of the deadline of the boom. A pendulum potentiometer and transmitter are provided on the boom adjacent its pivot point. A microprocessor is employed solve serial triangles using vector analysis and trigonometric functions to calculate the radius of rotation, the actual weight of the load and the percent of the load as compared to the maximum load for which the crane is designed.

15 Claims, 2 Drawing Sheets

FIG. 1
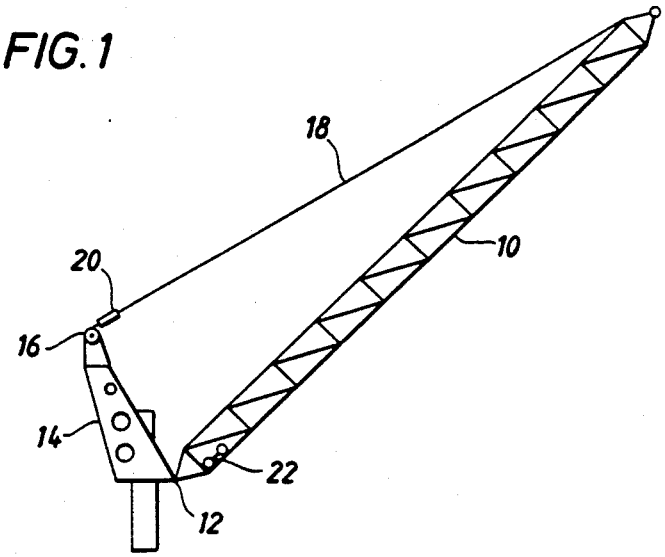
FIG. 2
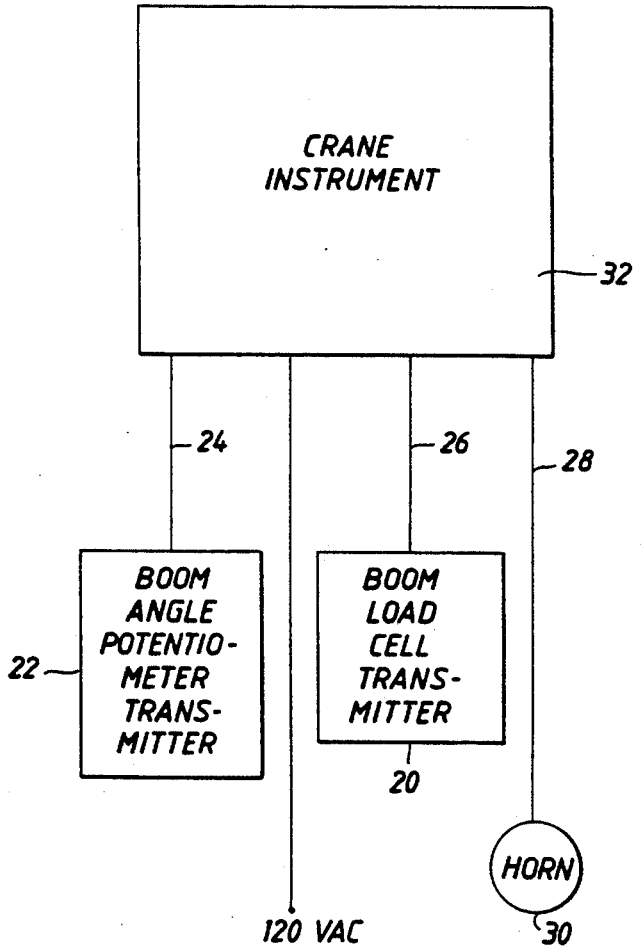
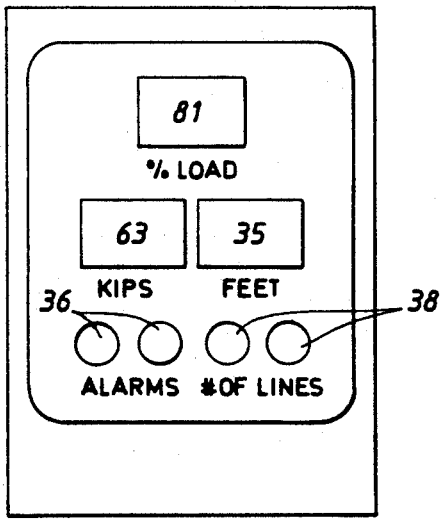
FIG. 6

CRANE LOAD INSTRUMENT AND METHOD THEREFOR

FIELD OF THE INVENTION

This invention relates generally to cranes for lifting and placing loads and more particularly relates to a load cell which is located in the deadline of the boom hoist and incorporates an electronic system for accurate calculation of the load on the cable system of the crane at any given time and thus computes the total weight of the load including the weight of the empty cable blocks and boom through utilization of trigonometric and vector analysis.

BACKGROUND OF THE INVENTION

It is critically important from the operation of cranes for lifting heavy loads that the operator of the crane have the capability of accurately identifying the actual weight of the load being lifted, including the load of various lifting components of the crane such as empty blocks, boom, etc. and for determining the percentage of the load being lifted in comparison with the maximum load for which the crane mechanism is designed.

In the past gantry cranes and other heavy lifting cranes have been provided with electronic load detection apparatus with the load cell being coupled in series with the deadline of the main hoist so that the load on the lines of the main hoist are measured directly and the angle of the boom is easily ascertained. These load cells, being located at or near the free end of the boom, are easily damaged by impacts caused by swinging of the main hoist block.

SUMMARY OF THE INVENTION

It is a principle feature of the present invention to provide a crane load instrument (CLI) that is unique from conventional crane load instruments in that the load cell is located in the deadline of the boom hoist and near the boom gantry as opposed to a location associated with the main hoist.

It is also a feature of this invention to provide a novel crane load instrument having its load cell mounted in series with the deadline of the boom hoist at a point near the gantry tie-down point of the boom hoist deadline.

It is also a feature of this invention to provide a pendulum potentiometer and transmitter mounted on the boom to measure boom angle and to provide a microprocessor-based electronics system that utilizes the boom angle and boom hoist deadline information to solve several triangles using vector and trigonometric functions to calculate the radius of rotation, the actual weight of the load and percentage of the load in comparison with the maximum load for which the crane mechanism is designed.

It is also a feature of this invention to provide a novel load cell arrangement for crane load instruments that insures that the load cell is always maintained in tension, thus eliminating the zero-shift problems that are associated with conventional crane load detection systems.

It is another important feature of this invention to provide a novel crane load instrument incorporating a load cell that is not subject to mechanical or electrical damage by shock loads or by being struck by the main blocks of the hoist mechanism during swinging thereof as the crane mechanism is being operated.

It is another feature of this invention to provide a novel crane load detection instrument that is capable of detecting with precision the actual load to which the crane is being subjected, whether the load is being lifted by the main blocks or on an extended jib boom and whip line.

It is another feature of this invention to provide a novel crane load detection system incorporating a crane load instrument that provides a "percent of load" readout based on both boom angle and load and provides both audible and visual alarms at a predetermined "caution" point and a visual and audible alarm and a shutdown contact upon detection of a load reaching 100% of the designed maximum load for the crane.

It is an even further features of this invention to provide a novel crane load detection system which allows the operator to set in number of lines on main blocks and whip line to allow the computer of the system to compute the load, the percent of the load in comparison with 100% for the new number of lines strung and the radius without any other recalibration.

It is another feature of this invention to provide a novel crane load detection mechanism having outputs available for remote read-outs and/or for the recording of the weight of the load being lifted.

It is also a feature of this invention to provide a novel crane load instrument having a load cell location that precludes it from being swung through hazardous areas as is typical with other crane load instruments.

Briefly, the present invention utilizes an electronic stain gage load cell that is mounted in series with the deadline of the boom hoist at a point near the gantry tie-down point of the boom hoist deadline. The instrument also incorporates a pendulum potentiometer and transmitter that are mounted on the boom in such manner so as to accurately measure boom angle. A microprocessor based electronics system is incorporated within the crane load instrument which receives the boom angle and boom hoist deadline information and, based on the dimensions of the crane, the load radius charts furnished by the manufacturer, the reaving of the boom hoist and main hoist, the weights of the boom, empty blocks, bridle blocks, and wire rope, solves several triangles using vector and trigonometric functions for calculation of the radius of rotation, the actual weight of the load (including the empty blocks) and the percent of the load in comparison with the maximum load for which the crane lifting mechanism is designed.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

FIG. 1 is a graphical representation in elevation illustrating a crane boom assembly with an electronic load cell and boom angle pendulum potentiometer in assembly therewith in accordance with the teachings of the present invention.

FIG. 2 is an electrical schematic diagram representing the crane load detection instrument of the present invention.

Figure 3:
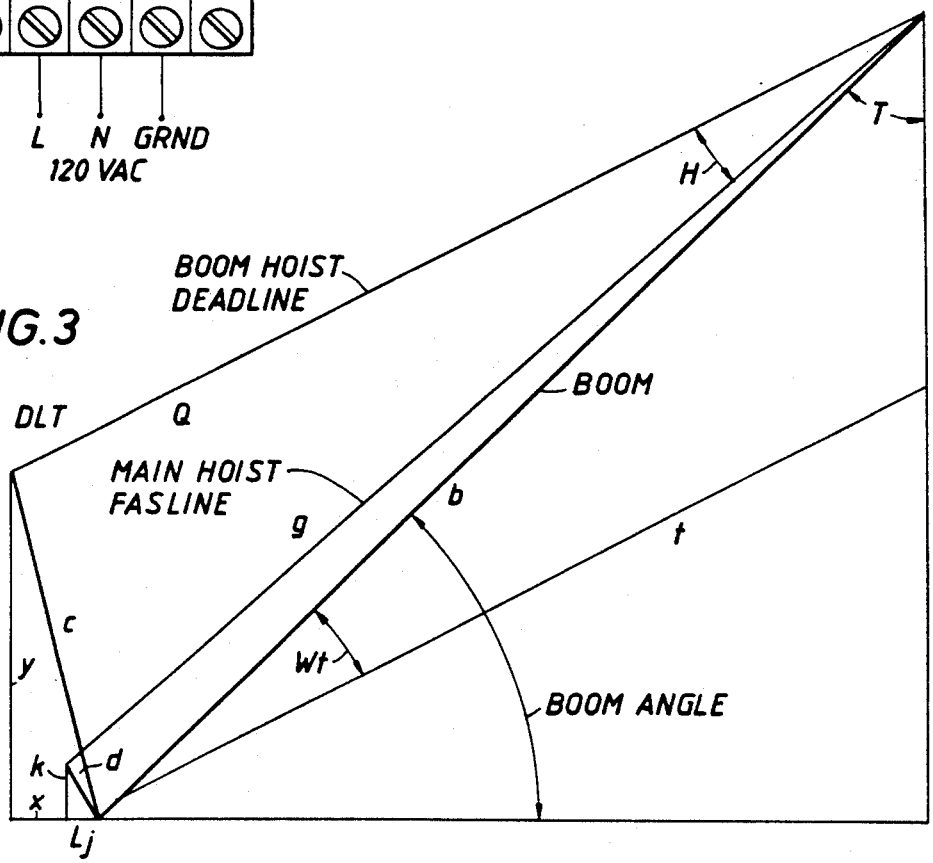

FIG. 3 is a crane load angle diagram representing computation of the actual load and the percentage of the load in accordance with the teachings of this invention.

Figure 4:
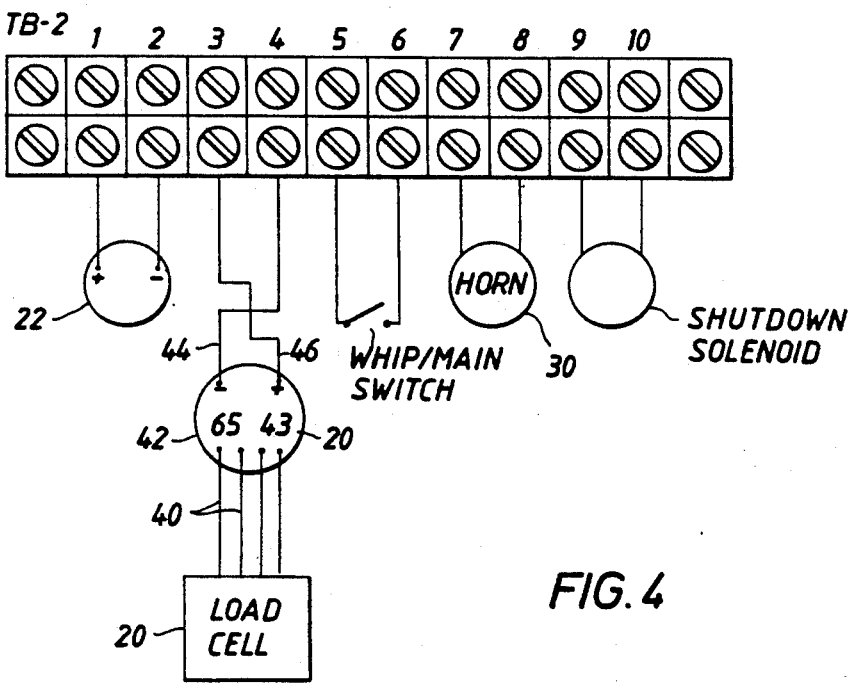

FIG. 4 is an electrical schematic representing the signal listing for input and output signals that are provided in accordance with the present invention.

Figure 5:
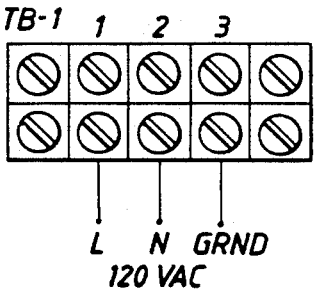

FIG. 5 is an electrical schematic illustration showing the power circuitry for the crane load instrument of this invention.

FIG. 6 is an elevational view of a load signal instrument for the instrument panel of a crane for providing the operator with visual and audible information relating to the load being lifted.

DETAILED DESCRIPTION OF THE PREFERRED EMBODIMENT

Referring now to the drawings and first to FIG. 1, a crane is shown having a boom 10 that is intended to rotate about a pivot 12 such as for lifting and placement of loads. The crane mechanism also incorporates a gantry 14 having a gantry tie-down point 16 for a boom hoist deadline 18. An electric strain gage load cell 20 is mounted in series with the deadline 18 of the boom hoist at a point near the gantry tie-down point 16 of the boom hoist deadline. A pendulum potentiometer and transmitter 22 are mounted on the boom to measure the precise angle of the boom and to provide an output signal representative thereof.

As shown in FIG. 2, a crane load instrument is shown having conductors 24 and 26 for conducting the respective signals of the boom angle potentiometer and transmitter 22 and the boom load cell transmitter 20 to the crane instrument. The crane instrument also incorporates an output conductor 28 that is coupled with a horn 30 to thus provide audible signals. The crane instrument 32 incorporates a microprocessor based electronics system that is capable of receiving data from the boom angle potentiometer and transmitter 22 and the boom load cell transmitter 20 and which is preprogrammed with information of the crane load mechanism for calculation of the radius of rotation, the actual weight of the load (including the empty blocks) and the percentage of the load in comparison with the maximum rated load for which the crane load mechanism is designed. The microprocessor receives the boom angle and boom hoist deadline information and, based on the dimensions of the crane mechanism, the load radius charts furnished by the manufacturer of the crane, the reaving of the boom hoist and the main hoist, and the weights of the boom, empty blocks, bridle blocks, and wire ropes solves several triangles as will be described hereinbelow utilizing vector and trigonometric functions for its calculations.

With reference now to FIG. 3, a crane load angle diagram is illustrated which illustrates a typical configuration for a crane. The boom length, b, the distance from the hinge point of the boom, c, and the distance from the hinge point of the boom to the main hoist line point of tangency, d, varies for each manufacturer and model of crane. Distances c and d are determined trigonometrically by solving triangles x, y, c and j, k, d from dimensional data furnished by the crane manufacturer. Using trigonometric and vector analysis, the crane load instrument computer or microprocessor solves for the triangles a, b, c; and b, g, d. Angle H is known after the solution of these triangles. With this information, the computer solves for Wt and t. Wt represents the total weight of the load including the weight of the empty blocks and boom. One half of the boom weight is subtracted from Wt to obtain the actual weight of the load and empty blocks. It should be noted that the tension in the main hoist fast line actually helps the boom hoist hold up the boom and load. Therefore, a component of the main hoist tension reduces the tension in the boom hoist deadline. This component can be calculated trigonometrically using the dimensions of the crane. In order to solve for Wt using the tension that is applied to the load cell, the load cell tension t has to be modified for the reduction in tension by the main hoist as follows:

$$W = t\left(\frac{\text{Sin } W}{\text{Sin}}\right)$$

$$\text{where } t = 6\left[DLT + \frac{(Wt - BW)(\cos H)}{ML \times BL}\right]$$

where

DLT = measured boom deadline tension

Wt = total weight including the empty blocks and ½ the boom weight

BW = ½ the empty boom weight

ML = number of lines strung on the main blocks

BL = number of lines strung on the boom hoist

H = the angle between the boom hoist lines and the main hoist fast line

The computer then subtracts the constant that is one half of the boom weight and arrives at a weight, w which is the weight for "load" displayed on the crane load instrument as "Load" which consists of the weight of the empty blocks and the load supported by the hook.

With the load and the radius known, the computer then compares these values with the values on the manufacturer's load-radius chart and computes and displays "percent of load". In this regard, reference is directed to FIG. 4 which is representative of an instrument that will be located on the instrument panel of the crane mechanism and which provides a display including not only the load representations but also visual alarms 36 and number of lines 38.

Referring now to FIGS. 5 and 6, the load cell 20 is shown to include a plurality of electrical conductors 40 establishing coupling thereof with a load cell transmitter 42. Load cell transmitter conductors 44 and 46 are coupled respectively to connectors of the terminal block 48 representing signal pins 4 and 3. The pins of the connector block respectively are pin 1—+24 volts DC, pin 2—pendulum potentiometer input, while pin 3 is identified as +24 volts DC. Pin 4 is the load cell input while pin 5 is a connector for +24 volts DC. Pin 6 is identified as a whip or line change input, while pin 7 identifies a horn 120 volt AC return. Pin 8 is identified as 120 volts AC for electrical power to the horn, pin 9 is identified as 120 volts AC for a customer-furnished shut-down solenoid if desired. Pin 10 is identified as a 120 volt AC return.

As shown in FIG. 6, pins 1, 2, and 3 are provided for power, neutral and ground connections as shown to provide electrical energy for the crane instrument mechanism.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A crane load detection system for a gantry crane mechanism having a boom with a main hoist and having a gantry establishing a gantry tie-down point, said gantry crane mechanism further having a boom hoist having a deadline connected to said gantry tie-down point, and including:

(a) an electronic strain gage load cell being located in said deadline of said boom hoist and providing an output signal representing the load being applied to said deadline and is located near said tie-down point of said gantry by said deadline;

(b) a pendulum potentiometer and transmitter being mounted on said boom for measuring the precise angle of said boom and providing an electrical output signal representing said boom angle; and (c) a microprocessor having inputs for receiving said output signals of said electronic strain gage load cell and said pendulum potentiometer and transmitter, said microprocessor being programmed with data representative of said crane including crane dimensions, load radius charts, reaving of the boom hoist and main hoist, and the weight of the boom, empty blocks, bridle blocks, and wire rope, said microprocessor solving triangles and using vector and trigonometric function calculating the radius of rotation, the actual weight of the load including the weight of the empty blocks and the percent of the load as compared to the maximum load for which said crane is designed.

2. The crane load detection system of claim 1, wherein said microprocessor is programmed to solve:

$$t = 6\left[DLT + \frac{(Wt - BW)(\cos H)}{ML \times BL}\right]$$

where:

DLT=measured boom deadline tension

Wt=total weight including empty blocks and ½ the boom weight

BW=½ the empty boom weight

ML=number of lines strung on the main blocks

BL=number of lines strung on the boom hoist; and

H=the angle between the boom hoist lines and the main hoist fast line.

3. The crane load detection system of claim 2, wherein:

said microprocessor is programmed to solve the triangle represented on two sides by t and Wt for Wt and to subtract the constant being ½ of the boom weight to compute the weight W representing the load being lifted.

4. The crane load detection system of claim 1, wherein:

said electronic strain gage load cell is located in said deadline of said boom and immediately adjacent the gantry tie-down of said deadline of said boom.

5. In a gantry crane mechanism having a gantry and a boom and a boom hoist for controlling the angle of said boom, said boom hoist having a deadline being connected to said gantry, the improvement comprising:

(a) an electronic strain gage load cell being connected in series with said boom hoist deadline at a location near said gantry and being continuously maintained in a state of tension, said electronic strain gage load cell providing electrical output signals representing the load being applied to said boom hoist deadline;

(b) a pendulum potentiometer and transmitter being fixed to said boom and providing electrical output signals representing the precise angle of said boom; and (c) a microprocessor having inputs receiving said electrical output signals of said electronic strain gage load cell and said pendulum potentiometer and transmitter and being programmed with data specific to said gantry crane mechanism to solve by vector and trigonometric functions the radius of rotation of said boom, the actual weight of the load and the percentage of the load in comparison with the maximum load for which said crane mechanism is designed.

6. The gantry crane mechanism of claim 5, wherein:

(a) said gantry forms a boom hoist deadline tie-down point; and (b) said electronic strain gage load cell being located in said boom hoist deadline.

7. The gantry crane mechanism of claim 6, wherein:

said electronic strain gage load cell is located near said gantry tie-down point.

8. The gantry crane mechanism of claim 5, wherein said microprocessor is programmed to solve:

$$t = 6\left[DLT + \frac{(Wt - BW)(\cos H)}{ML \times BL}\right]$$

where:

DLT=measured boom deadline tension

Wt=total weight including empty blocks and ½ the boom weight

BW=½ the empty boom weight

ML=number of lines strung on the main blocks

BL=number of lines strung on the boom hoist; and

H=the angle between the boom hoist lines and the main hoist fast line.

9. The gantry crane mechanism of claim 5, wherein:

said microprocessor is programmed to solve the triangle represented on two sides by t and Wt for Wt and to subtract the constant being ½ of the boom weight to compute the weight W representing the load being lifted.

10. In a gantry crane mechanism having a gantry and a boom and a boom hoist for controlling the angle of said boom, said boom hoist having a deadline being connected to said gantry, the improvement comprising:

(a) an electronic strain gage load cell being connected in series with said boom hoist deadline and providing electrical output signals representing the load being applied to said boom hoist deadline;

(b) boom angle means providing electrical output signals representing the precise angle of said boom; and (c) a microprocessor having inputs receiving said electrical output signals of said electronic strain gage load cell and said boom angle means and being programmed to solve:

$$t = 6\left[DLT + \frac{(Wt - BW)(\cos H)}{ML \times BL}\right]$$

where:

DLT=measured boom deadline tension

Wt=total weight including empty blocks and ½ the boom weight

BW=½ the empty boom weight

ML=number of lines strung on the main blocks

BL=number of lines strung on the boom hoist; and

H=the angle between the boom hoist lines and the main hoist fast line.

11. The gantry crane mechanism of claim 10, wherein:

said microprocessor is programmed to solve the triangle represented on two sides by t and Wt for Wt and to subtract the constant being ½ of the boom weight to compute the weight W representing the load being lifted.

12. The gantry crane mechanism of claim 10, wherein:

(a) said gantry forms a boom hoist deadline tie-down point; and (b) said electronic strain gage load cell being located in said boom hoist deadline.

13. The gantry crane mechanism of claim 12, wherein:

said electronic strain gage load cell is located near said gantry tie-down point.

14. The gantry crane mechanism of claim 10, wherein:

said electronic strain gage load cell is interconnected with said boom hoist deadline in such manner that said electronic strain gage load cell is continuously maintained in tension.

15. The gantry crane mechanism of claim 10, wherein:

(a) said boom angle means is a pendulum potentiometer and transmitter having an electronic signal output being coupled with a boom angle signal input of said microprocessor; and (b) said microprocessor being programmed to solve by vector and trigonometric functions to calculate the radius of rotation of said boom, the actual weight of the load and the percentage of the load in comparison with the maximum load for which the crane mechanism is designed.

* * * * *